United States Patent [19]

von Gentzkow et al.

[11] Patent Number: 4,472,700

[45] Date of Patent: Sep. 18, 1984

[54] TRANSFORMER WITH COPPER WINDINGS, LIQUID INSULATION MATERIAL AND SUPPLY DEPOT CONTAINING SOLID COPPER DEACTIVATOR TO PREVENT DISSOLUTION OF THE COPPER

[75] Inventors: Wolfgang von Gentzkow, Kleinsendelbach; Hubert Deml, Schwanstetten; Karl Soldner, Nuremberg, all of Fed. Rep. of Germany

[73] Assignee: Siemens Aktiengesellschaft, Berlin and Munich, Fed. Rep. of Germany

[21] Appl. No.: 450,766

[22] Filed: Dec. 17, 1982

[30] Foreign Application Priority Data

Dec. 18, 1981 [DE] Fed. Rep. of Germany ..... 3150361
Jan. 18, 1982 [DE] Fed. Rep. of Germany ..... 3201298

[51] Int. Cl.[3] ..... H01F 27/10

[52] U.S. Cl. ..... 336/57; 336/58; 174/14 R

[58] Field of Search ..... 174/14 R, 15 R; 336/55, 336/57, 58, 60

[56] References Cited

U.S. PATENT DOCUMENTS 2,985,706 5/1961 Dobry ..... 174/14 R
4,234,754 11/1980 Edwards et al. ..... 174/14 R

FOREIGN PATENT DOCUMENTS 71619 6/1977 Japan ..... 174/14 R
3243 1/1979 Japan ..... 174/14 R
330617 6/1958 Sweden ..... 336/57

*Primary Examiner*—G. P. Tolin
*Assistant Examiner*—Susan Steward
*Attorney, Agent, or Firm*—Herbert L. Lerner; Laurence A. Greenberg

[57] ABSTRACT

Transformer, including copper windings, electrical insulation for the windings, the electrical insulation being formed of sections of solid and liquid insulating material, the liquid insulating material serving as a cooling liquid containing a chemical compound from the class of N,N'-dihydrazides as a copper deactivator in a cooling liquid flow, and a supply depot disposed in the cooling liquid flow containing the copper deactivator as a solid material.

15 Claims, 2 Drawing Figures

TRANSFORMER WITH COPPER WINDINGS, LIQUID INSULATION MATERIAL AND SUPPLY DEPOT CONTAINING SOLID COPPER DEACTIVATOR TO PREVENT DISSOLUTION OF THE COPPER

BACKGROUND OF THE INVENTION

1. Field of the Invention

The invention relates to transformers with an electrical insulation for the windings thereof constructed from copper sections, of solid and liquid insulating materials which together are effective in insulating the copper sections, the liquid insulating materials of which serves at the same time as the cooling liquid.

2. Description of the Prior Art

Tests on transformers with windings of copper sections have shown that metallic copper as well as copper which is dissolved in the oil are catalysts for the thermally oxidative aging of oil and cellulose. Through this oxidative aging process, the service life of transformers, especially of such transformers having a large amount of dissipation, is limited due to aging.

In addition, the copper which is dissolved and oxidized during the transformer operation through the influence of aging products of the oil and the cellulose can be deposited under reducing conditions as predominantly metallic copper on insulating parts, weakening or even damaging the insulation.

One possibility for preventing copper from the winding and its leads from being dissolved by transformer oil consists of covering the exposed copper surfaces by varnishing. While this method is used, it is expensive from a manufacturing point of view. A further possibility for covering the copper surfaces consists of nickel-plating them. This method, however, is less economical than varnishing the exposed copper surfaces.

Another method for preventing oxidation and dissolution of copper by the transformer oil is to add stabilizing additives to the transformer oil. An additive which is suitable for this purpose is, for instance, 2,6-di-tert.butyl-p-cresol which, when dissolved in the oil, acts as an oxidation inhibitor. It is a disadvantage of this solution to the oxidation problem, however, that such oxidation inhibitors must be completely dissolved in the transformer oil in relatively large amounts to be effective.

The dissolution and absorption of copper by transformer oil can also be prevented in principle by employing catalytically less active aluminum as the material for the winding conductors, instead of copper. However, the use of aluminum as an alternative to copper in windings of large transformers has not found acceptance so far, since with the existing price relationship to copper, aluminum does not offer enough advantages because of its lower electric conductivity, its less advantageous mechanical properties and its poorer workability.

SUMMARY OF THE INVENTION

It is accordingly an object of the invention to provide a transformer with copper windings, which overcomes the hereinafore-mentioned disadvantages of the heretofore-known devices of this general type, and in which the dissolution and absorption of copper by the transformer oil are reliably prevented in an economical manner, so that even with direct mutual contact of copper conductors and transformer oil, no oxidative aging caused thereby is brought about.

With the foregoing and other objects in view there is provided, in accordance with the invention, a transformer, comprising windings, electrical insulation for the windings, the electrical insulation being formed of sections of solid and liquid insulating material, the liquid insulating material serving as a cooling liquid containing a chemical compound from the class of N,N'-dihydrazides as a copper deactivator in a cooling liquid flow, and a supply depot disposed in the cooling liquid flow containing the solid insulating material as a solid copper deactivator.

In accordance with another feature of the invention, the copper deactivator is chosen from the group consisting of at least one of N,N'-bis-salicyloyl-hydrazine, or N,N'-diacyl-dicarbonic-acid dihydrazide such as N,N'-dipelargonyl-terephthalic-acid dihydrazide.

In accordance with a further feature of the invention, the solid copper deactivator in the supply depot is a crystalline copper deactivator.

In accordance with an added feature of the invention, the concentration of the copper deactivator in the liquid insulating material represented by a hydrocarbon is substantially 0.01% by weight.

In accordance with an additional feature of the invention, the solid insulating material is in the form of material being more thermally stable than normal cellulose materials.

In accordance with again another feature of the invention, there is provided a transformer tank containing the windings and the insulating materials, the tank being hermetically sealed from the ambient air.

In accordance with again a further feature of the invention, there is provided at least one oxidation inhibitor disposed in at least one of the liquid insulating material and/or the supply depot in addition to the copper deactivator.

In accordance with again an added feature of the invention, the oxidation inhibitor is 2,6-di-tert.butyl-p-cresol.

In accordance with again an additional feature of the invention, the supply depot is disposed in a bag of small mesh, oil resistant, heat resistant and aging resistant material.

In accordance with yet another feature of the invention, the small mesh material is chosen from the group consisting of glass, alloy steel and "Kelvar". Kelvar is a trademark for Aramid Fibers—high strength aromatic amide fibers produced by DuPont and having the chemical composition—poly (1.4-phenylene terephthalamide).

In accordance with another feature of the invention, the bag is disposed above the windings in the coolant flow loop, and includes means for permitting monitoring of the content of the bag during operation of the transformer.

In accordance with an added feature of the invention, there is provided a transformer tank having a cover and containing the windings and the insulating materials, the tank being hermetically sealed from the ambient air, the bag being disposed at the cover.

In accordance with a concomitant feature of the invention, there are provided a cooler, a pipeline having two parallel branches connected from the tank to the cooler, the supply depot being connected in one of the branches, two gate valves each being connected on one side of the supply depot in the one branch and another gate connected in the other branch for separately shutting off the branches.

The use of copper deactivators according to the invention is very advantageous, since they are effective even in small amounts, and although they have not been detectable to date in the transformer oil, when in contact with the transformer oil they nevertheless greatly delay the aging of the insulating material system formed of transformer oil and cellulose. The use of these copper deactivators, in combination with one or more oxidation inhibitors, results in a further advantageous delay of the aging of the insulating material system.

Other features which are considered as characteristic for the invention are set forth in the appended claims.

Although the invention is illustrated and described herein as embodied in a transformer with copper windings, it is nevertheless not intended to be limited to the details shown, since various modifications and structural changes may be made therein without departing from the spirit of the invention and within the scope and range of equivalents of the claims.

BRIEF DESCRIPTION OF THE DRAWINGS

The construction and method of operation of the invention, however, together with additional objects and advantages thereof will be best understood from the following description of specific embodiments when read in connection with the accompanying drawings, in which.

DESCRIPTION OF THE PREFERRED EMBODIMENTS

Figure 1:
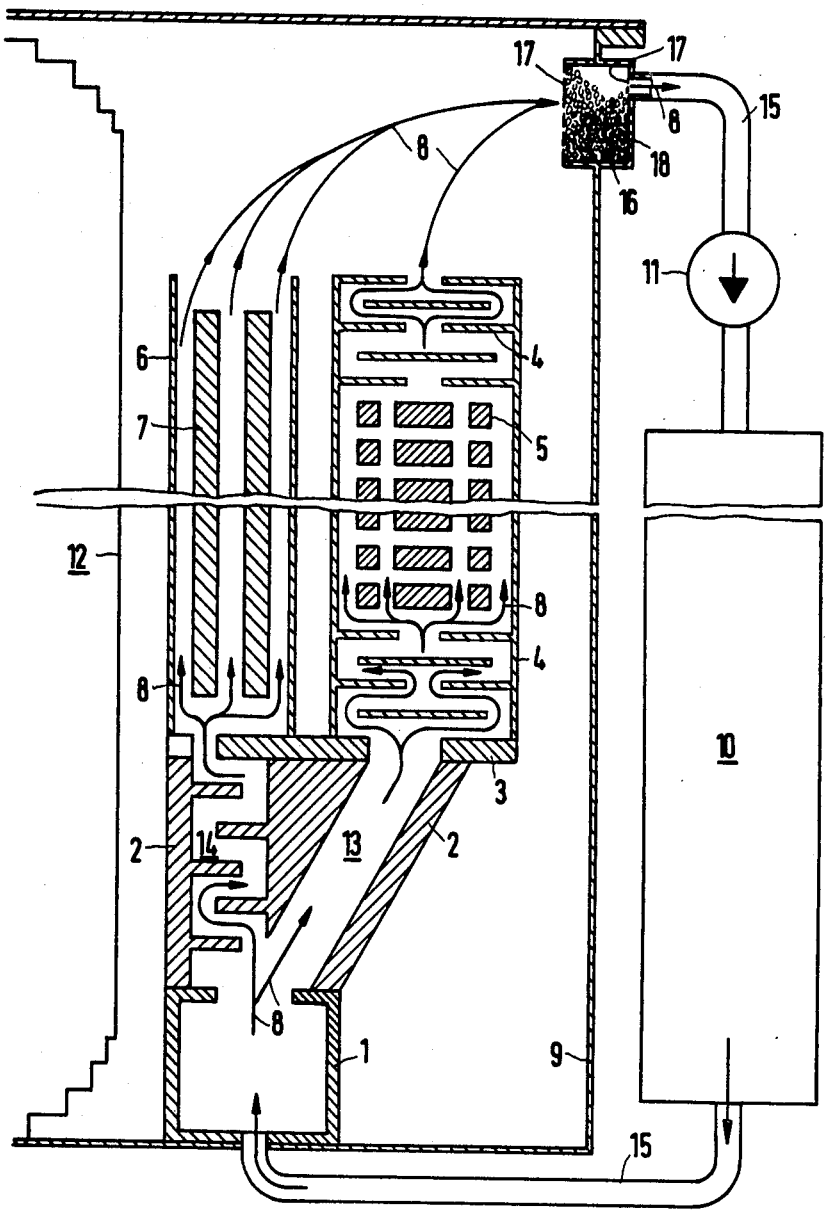
FIGS. 1 and 2 are similar fragmentary, diagrammatic, partially cross-sectional views of two embodiment examples of the invention.

Referring now to the figures of the drawing and first particularly to FIG. 1 thereof, it is seen that a core 12 is installed in an oil-filled tank 9 for a transformer. The core leg 12 is surrounded by an inner low-voltage winding 7 and a radially outer high-voltage winding 5. The low-voltage winding 7 is electrically insulated by shielding barriers 6 and the high-voltage winding 5 is electrically insulated by shielding barriers 4 of solid material with a cellulose base.

The low-voltage winding 7 as well as the high-voltage winding 5 are supported by a winding support table 3, which is in turn carried through supports 2 by a clamping frame 1. The configuration formed of the clamping frame 1, the supports 2 and the winding table 3 serves, together with corresponding non-illustrated parts on the upper surface of the windings 5 and 7, for compressing the same in the axial direction, as well as for fixing the windings relative to the core 12.

The clamping frame 1 is constructed in such a way as to be hollow and serves at the same time as a coolant feed duct by virtue of its connection to a pipeline 15 coming from a cooler 10. Channels 13 and 14 in the supports 2 serve for conducting the cooling liquid in the direction of the arrows 8. The flow velocity of the coolant in the direction of the arrows 8 is set by a pump 11.

After leaving the upper winding ends, the coolant passes a supply depot 16 on its way along the direction of the arrows 8, before entering the pipeline 15 leading to the pump 11. The depot 16 is built firmly into the upper part of a side wall of the tank 9 and is delineated or separated from the interior of the tank 9 as well as in the direction toward the pipeline 15 by screens 17. The screens 17 hold a supply of a copper deactivator, such as N,N'-bis-salicyloy hydrazine in the flow of the coolant. Optionally, an oxidation inhibitor, such as 2,6-di-tert.butyl-p-cresol, is admixed to the copper deactivator. The supply and the appearance of the copper deactivator and the oxidation inhibitor can be monitored in the operating condition from the outside through a window 18.

Figure 2:
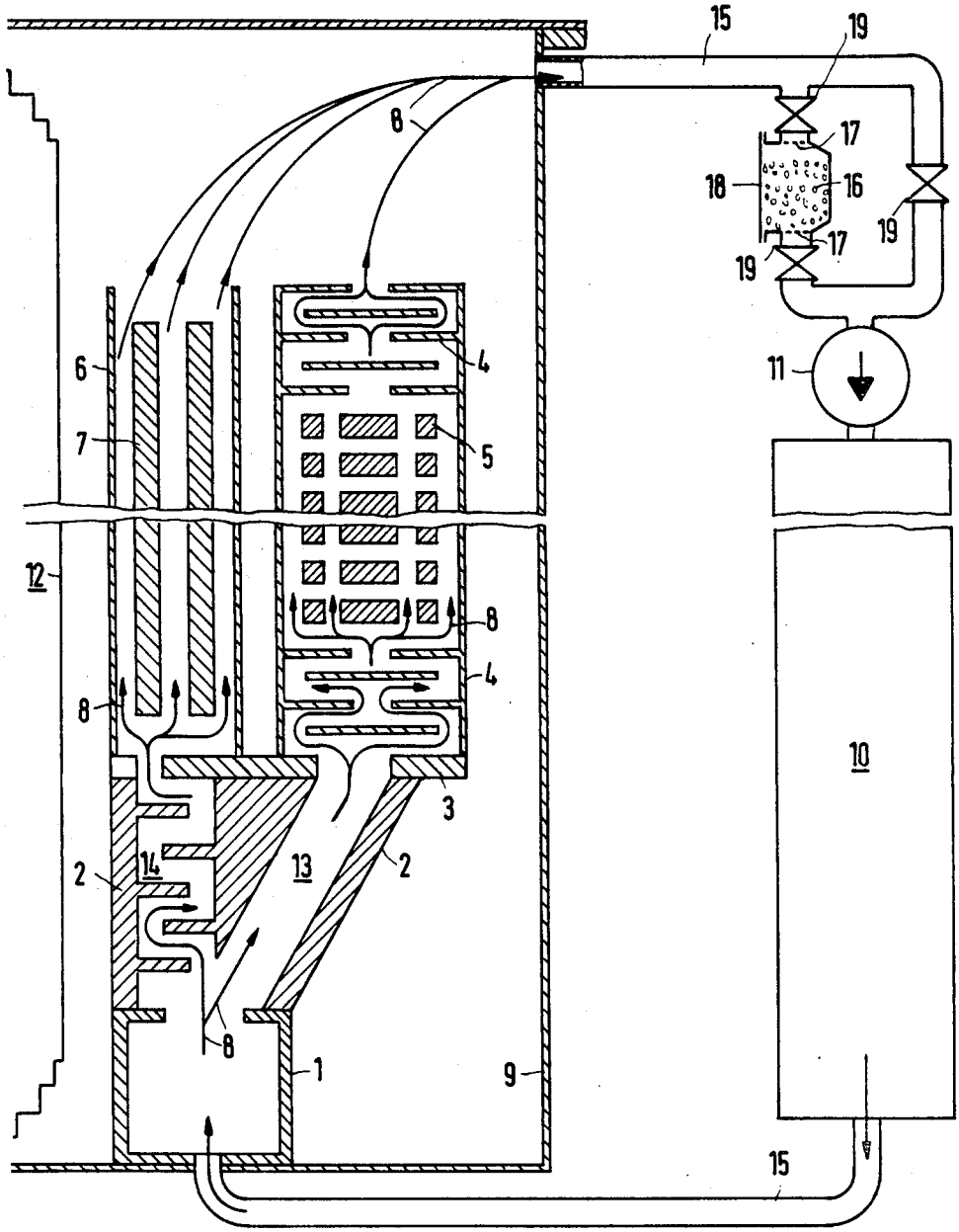

FIG. 2 shows a transformer with a cooler 10 which is mounted at a somewhat greater distance from the tank 9 associated therewith. The tank 9 and the cooler 10 are again connected to each other by pipelines 15, and the coolant flow is driven by a pump 11 disposed at the entrance to the cooler, as viewed in the direction of the arrows 8.

In this embodiment example, the pipeline 15 is divided over part of the distance between the tank 9 and the pump 11 into two parallel branches, each of which can conduct the entire coolant flow by itself. In one of these branches, the supply depot 16 is disposed between two gate valves 19, and in the other branch, only a single gate valve 19 is used.

In normal operation, the branch containing the supply depot 16 carries the entire coolant flow. Before inspection and/or maintenance work on the depot 16 is undertaken, the gate valve 19 in the branch bypassing the depot is opened first, before the gate valves at the entrance and the exit of the depot 16 are closed. Thereafter, it is possible to open or disassemble the depot 16 without interrupting the operation of the transformer. Before the depot 16 is put back into operation, the latter is evacuated and the vacuum produced is filled with transformer oil.

In non-illustrated transformers without a separate cooler 10, such as transformers with a corrugated wall tank, the depot 16 is advantageously accomodated in a chamber suspended from the tank cover. In the operating condition, this chamber is open toward the interior of the tank, so that transformer oil flows through the depot. For inspection and maintenance work on the depot, the chamber can be shut off from the interior of the tank.

We claim:

1. Transformer, comprising copper windings, electrical insulation for said windings, said electrical insulation being formed of sections of solid and liquid insulating material, said liquid insulating material serving as a cooling liquid containing a chemical compound from the class of N,N'-dihydrazides as a copper deactivator in a cooling liquid flow, and a supply depot disposed in said cooling liquid flow containing said copper deactivator as a solid material to prevent dissolution and absorption of copper by the liquid insulating material.

2. Transformer according to claim 1, wherein said copper deactivator is selected from the group consisting of at least one of N,N'-bis-salicyloyl-hydrazine, N,N'-diacyl-dicarbonic-acid dihydrazide and N,N'-dipelargonyl-terephthalic-acid dihydrazide.

3. Transformer according to claim 1, wherein said solid copper deactivator in said supply depot is a crystalline copper deactivator.

4. Transformer according to claim 2, wherein said solid copper deactivator in said supply depot is a crystalline copper deactivator.

5. Transformer according to claim 2, wherein the liquid insulating material is a hydrocarbon, and wherein the concentration of said copper deactivator in said liquid hydrocarbon insulating material is substantially 0.01% by weight.

6. Transformer according to claim 1, wherein the liquid insulating material is a hydrocarbon, and wherein the concentration of said copper deactivator in said liquid hydrocarbon insulating material is substantially 0.01% by weight.

7. Transformer according to claim 1, including a transformer tank containing said windings and said insulating materials, said tank being hermetically sealed from the ambient air.

8. Transformer according to claim 1, including at least one oxidation inhibitor disposed in said liquid insulating material in addition to said copper deactivator.

9. Transformer according to claim 8, wherein said oxidation inhibitor is 2,6-di-tert.butyl-p-cresol.

10. Transformer according to claim 1, wherein said supply depot is disposed in a bag of small mesh, oil resistant, heat resistant and aging resistant material.

11. Transformer according to claim 10, wherein said small mesh bag is formed of material selected from the group consisting of glass, alloy steel and high-strength aromatic amide fibers.

12. Transformer according to claim 10, wherein said bag is disposed above said windings in said coolant flow, and including means for monitoring of the content of said bag during operation of the transformer.

13. Transformer according to claim 11, wherein said bag is disposed above said windings in said coolant flow, and including means for monitoring of the content of said bag during operation of the transformer.

14. Transformer according to claim 12, including a transformer tank having a cover and containing said windings and said insulating materials, said tank being hermetically sealed from the ambient air, said bag being disposed at said cover.

15. Transformer according to claim 7, including a cooler, a pipeline having two parallel branches connected from said tank to said cooler, said supply depot being connected in one of said branches, two gate valves each being connected on one side of said supply depot in said one branch and another gate connected in the other branch for separately shutting off said branches.

* * * * *